United States Patent [19]

Barr et al.

[11] 4,022,616

[45] May 10, 1977

[54] PHOTOGRAPHIC PROCESS INVOLVING AMPLIFICATION WITH CO (III) COMPLEXES, SILVER-DYE-BLEACHING AND COLORLESS DYE FORMERS WHICH FORM BLEACHABLE DYES

[75] Inventors: Charles Robert Barr, Rochester; John Vincent Williams, Pittsford, both of, NY

[73] Assignee: Eastman Kodak Company, Rochester, N.Y.

[22] Filed: Mar. 1, 1976

[21] Appl. No.: 662,306

Related U.S. Application Data

[63] Continuation of Ser. No. 475,677, June 3, 1974, abandoned.

[52] U.S. Cl. ..... 96/20; 96/22; 96/53; 96/55; 96/60 BF; 96/61 R

[51] Int. Cl.[2] ..... G03C 7/16; G03C 7/00; G03C 5/38; G03C 5/32

[58] Field of Search ..... 96/53, 55, 20, 22, 61 R, 96/60 B, 60 F

[56] References Cited

UNITED STATES PATENTS

| | | | |
|---|---|---|---|
| 3,293,032 | 12/1966 | Jaekan et al. | 96/53 |
| 3,503,741 | 3/1970 | Wilson et al. | 96/53 |
| 3,765,891 | 10/1973 | Travis | 96/55 |
| 3,841,873 | 10/1974 | Mowrey et al. | 96/55 |

*Primary Examiner*—David Klein
*Assistant Examiner*—Richard L. Schilling
*Attorney, Agent, or Firm*—Carl O. Thomas

[57] ABSTRACT

A process is disclosed for producing a positive colored image in an imagewise exposed photographic element. The element is comprised of a support having coated thereon at least one layer of a hydrophilic colloid coating containing at least one light-sensitive silver halide and, in association with said silver halide, a substantially colorless, image dye-providing compound. The image dye-providing compound is reactive with oxidized color-forming reducing agent to yield a bleachable image dye. The process is comprised of the following steps: A silver image is developed in the imagewise exposed areas of the photographic element and a low level silver fog is formed in the remaining areas of the element. Image dye-providing compound is then converted to a bleachable image dye uniformly throughout the photographic element using the silver as a catalyst for a redox reaction of a color-forming reducing agent and a cobalt(III) complex amplifier oxidizing agent. A silver-dye-bleach step is then performed which bleaches the uniformly generated dye in proportion to the amount of silver present. This produces a positive dye image. Finally, the photographic element is fixed.

20 Claims, No Drawings

PHOTOGRAPHIC PROCESS INVOLVING AMPLIFICATION WITH CO (III) COMPLEXES, SILVER-DYE-BLEACHING AND COLORLESS DYE FORMERS WHICH FORM BLEACHABLE DYES

This is a continuation of U.S. Ser. No. 475,677, filed June 3, 1974 and now abandoned.

FIELD OF THE INVENTION

This invention relates to the art of color photography and in particular to novel photographic processes which involve the use of a silver-dye-bleach step.

BACKGROUND OF THE INVENTION

The production of multicolor images by the so-called silver-dye-bleach process is based on the use of a photographic element comprising a plurality of superposed silver halide emulsion layers, each of which contains a bleachable dye of a color complementary to the color of that portion of the spectrum to which the respective silver halide layer is sensitive. In the practice of the silver-dye-bleach process, the element is exposed, developed and subsequently treated in a special acidic bleach bath wherein the dyes are rendered colorless in proportion to the metallic silver produced during development. After removal of the residual silver and silver halide by silver bleach, fixing, and washing, a positive dye image is obtained. A common silver-dye-bleach process as described above suffers from the disadvantage that the dyes incorporated in the light-sensitive silver halide emulsion layers absorb a sufficient amount of the exposing light to reduce the effective speed of the film material.

Various methods have been employed to overcome this disadvantage. One such method has consisted of placing the dyes in separate coating layers below the silver halide layers. While such a transposition of the dyes has improved the effective speed of the film somewhat, it has also led to unsharp images due to the increased thickness of the film which has brought about a scattering of the exposing light and created a longer diffusion path along which the dye bleach catalyst has to travel from the silver to the dye. Other attempts to overcome the above-described shortcoming, such as false sensitization or dyeing of the film after exposure, have been equally unsatisfactory. The replacement of the preformed azo dye by various forms of colorless precursors of the dyes, such as, for example, nitroso compounds or azo couplers, has also proven to be of only limited advantage inasmuch as the conversion of the precursors to their respective dyes requires at least one additional processing step. A fourth known metod of enhancing the speed of conventional silver-azo-dye-bleach materials has been that of incorporating into the material special azo dyes which can exist in differently colored forms, depending on the pH of the surrounding medium. During the exposure, such pH-sensitive dyes are of a color suitable to transmit light of those wavelengths to which the layers containing the dyes, or the layers lying beneath them, are sensitive. Again, such a method is undesirable because an additional pH-changing treating bath is required in order to shift the hue of the dyes to that which is desirable in the finished image, and because these special dyes generally have poor stability upon prolonged keeping.

It is also known in the art that colorless dye precursors can be used instead of the bleachable dyes. For example, U.S. Pat. No. 3,503,741 to Wilson et al discloses a silver-dye bleach process wherein colorless tetrazolium salts are utilized as precursors for the bleachable dyes. This material alleviates the speed loss as described, but the salts can chemically desensitize the silver halide grains during pre-exposure storage.

There is, of course, a need for improved photographic elements and processes wherein the elements contain colorless dye precursors which do not interfere with the desired image-making chemistry and wherein the photographic elements can have very high effective exposure speeds.

STATEMENT OF THE INVENTION

We have now discovered an improved photographic development process for developing photographic elements which contain bleachable dye precursors. Such elements comprise a support and at least one layer thereon containing a silver halide emulsion having associated therewith a dye-providing, colorless compound which, upon reaction with a color-forming reducing agent yields a bleachable dye. Generally, our novel process comprises a. forming a negative silver image record by subjecting the element to black-and-white development, while simultaneously forming a uniform low density silver "fog" in the non-image areas of said element;

b. subsequently uniformly converting the dye-providing colorless compound to said dye by contacting the black-and-white developed element with a special amplifier/developer solution containing a colbalt (III) complex amplifier oxidizing agent and a color-forming reducing agent;

c. then subjecting the resulting element (containing bleachable dye, a silver image record and a uniform silver background fog) to a silver-dye-bleach step; and d. thereafter removing the metallic silver (and any remaining silver halide) from the element.

The net result of our process is a "positive" colored image record comprising bleachable dyes, which record has been obtained in the essential absence of the problems described above. For example, the problem of unwanted absorption of light by bleachable dye (during imagewise exposure of the element) does not exist in the practice of the present invention because the dye is formed in our process after imagewise exposure. The element therefore has a very high effective exposure speed. In addition, no subsequent pH adjustment step is necessary for the successful practice of our process.

It is noteworthy that, in step (*b*) of our process (as described above), dye is formed throughout the emulsion layer(s), the resulting dye density being fairly uniform through each affected emulsion layer. Also, at this point in our process, each layer has a silver image record, and otherwise a uniform, very low level background silver fog. The silver-dye-bleaching of an element containing this type of metallic silver distribution results in the "bleaching" of dye imagewise, to thereby form a positive color image. In the non-image areas, only an insignificant quantity of dye is destroyed because of the very low concentration of metallic silver in the fogged background areas of the element.

The "amplifier/developer solution" referred to in step (*b*) of our process is comprised of (i) at least one color-forming reducing agent (a colorless color developing agent) plus (ii) a cobalt (III) complex oxidizing agent having a coordination number of 6. The color-forming reducing agent and the cobalt (III) complex amplifier oxidizing agent are catalyzed to react by the silver present in the photographic element. Both the image silver and the silver produced by fogging of background areas offers sufficient catalyst to cause essentially complete formation of dye. Since the redox reaction of the color-forming reducing agent and the cobalt (III) complex amplifier oxidizing agent occur uniformly over the entire area of the photograhic element, the image dye is formed uniformly over the entire area of the photographic element.

In one preferred embodiment, this invention relates to an improved process of producing dye imagewise in an imagewise and flash-exposed photographic element having a support and at least one layer thereon containing a silver halide emulsion having associated therewith a substantially colorless image dye-providing compound, such a color-forming coupler wherein said process comprises contacting said photographic element with a black-and-white developer and then contacting said element with a color-developer amplifier solution wherein the solution contains a color-forming reducing agent, such as a color-developing agent, and a cobalt (III) metal complex having a coordination number of 6. Said composition is maintained in contact with said photograhic element under conditions which reduce cobalt (III) to cobalt (II) and which in turn oxidize said color-forming reducing agent. Image is formed upon the reaction of the image dye-providing compound with the oxidized color-forming reducing agent. The element can then be treated in a rapid silver-dye-bleach process to form a positive color image. Generally, the improved process of this invention eliminates the necessity of incorporating a light absorbing bleachable dye in the light-sensitive silver halide emulsion layers. Generally, this process results in high exposure speeds and is especially suited to rapid processing of our photographic element and in processing multicolor photograpic elements.

In another preferred embodiment, the color-forming reducing agent is an aromatic primary amino compound which upon oxidation coupling with an initially colorless coupler produces indoaniline, indophenol, azomethine or azo dyes.

In another embodiment, the color-forming reducing agent is a heterocyclic hydrazone which upon oxidative condensation with initially colorless phenols or aromatic amines produce amidrazone dyes.

In another embodiment, the color-forming reducing agent is a P-arylsulfonhydrayide which upon coupling with phenols produce azo dyes.

In still another embodiment of this invention, a process is provided for obtaining multicolor images in an exposed photographic element including a support having coated thereon at least three separate overlying hydrophilic colloid layers sensitized to red, green and blue radiation; each of such layers having in association therewith, respectively, a colorless dye former, such as a color-forming coupler, which provides, respectively, cyan, magenta and/or yellow bleachable dye upon reaction with oxidized color-forming reducing agent. One step of the process involves contacting an appropriate element, which has been (a) imagewise exposed and (b) overall lightly fogged, with a black-and-white developer to form metallic silver, then with a developer-/amplifier solution containing a color-forming reducing agent and a cobalt (III) metal complex oxidizing agent to form bleachable dye in at least one of the layers. Metallic silver produced in both the image and the non-image areas during development catalyses the redox-couple reaction between the cobalt metal complex oxidizing agent and the reducing agent. The resulting oxidized reducing agent (color developing agent), in turn, couples or condenses with the incorporated dye-former (e.g. color-forming coupler) to produce dye throughout the entire emulsion layer. The element is then silver-dye-bleached, with the bleachable dye being completely bleached out in the densest portions of the imagewise exposed areas by the quantitatively predominating image silver. Because of the rather low concentration of metallic silver in the non-image areas, only an insignificant quantity of dye is destroyed in such areas.

One important aspect of this invention relates to the low level of "background fog" which is referred to in the process set out above. (For convenience and clarity, this "background fog" will sometimes be referred to herein as "non-image silver".) Such non-image silver must:

i. have a minimum silver density of at least about 0.08 optical density units, which can be measured at any position free of image silver of the element; and
ii. have a maximum silver density equal to (*a*) at most about 20 percent of the maximum silver density in the image area of said element, where the silver is employed as a reducing agent (*b*) be present at a level of at most about 20 percent, based on the bleachable dye equivalent in the particular color layer being considered that is, in background areas, the non-image silver will be at most that required to bleach 20% of the imaging dye present.

The necessity for this "minimum" silver density requirement can be appreciated when it is realized that enough non-image silver must be present to catalyze effectively the development of substantially all of the color-forming material in the element (to form dye) during the amplifier/color development step of the present process. [In that step, color is formed uniformly throughout the respective color-forming layer(s) of the photographic element.] The amount of non-image silver must also be kept relatively low, as compared to image silver in the photographic element because in the subsequent silver-dye-bleach step, the amount of bleaching caused by the non-image silver in the element must be relatively low, as compared to that caused by the image silver.

The non-image silver can be produced by methods well-known in the art. Such methods include a low level flash-induced formation of metallic silver as well as a prolongation of the black-and-white development cycle beyond the time required to produce an image of low minimum density. Also, controlled chemical fogging can be employed to obtain the desired degree of uniform low level background fog, for example, by using a chemical foggant such as sodium borohydride prior, during, as subsequent to the black-and-white development step of our process.

Another important aspect of this invention relates to the use of special amplifier/developer solutions to "develop up" (preferably substantially all of) the bleachable dye in the element even though only very small amounts of metallic silver are present in some parts of the element. The amplifier/developer solutions which are useful in the practice of this invention contain, dissolved therein, amplifier compounds comprising one or more cobalt (III) metal complexes such as those described in detail in Travis U.S. Pat. No. 3,765,891 issued Oct. 16, 1973.

the amplifier compounds of the amplifier/developer solutions comprise a cobalt (III) metal complex that can be used with color developers in solution and feature a molecule having a cobalt atom or ion. This cobalt atom or ion is surrounded by groups of atoms, ions or other molecules which are generically referred to as ligands. The cobalt atom or ion in the center of these complexes is a Lewis acid; the ligands are Lewis bases. Werner complexes are well-known examples of such complexes. As indicated above, the useful cobalt complex salts are those described in Travis U.S. Pat. No. 3,765,891. Especially preferred cobalt metal complexes are the cobalt hexammine salts, i.e. $[Co(NH_3)_6]Cl_3$.

The silver-dye-bleach step of our invention can be any of the well-known procedures described in the art wherein azo dyes are reductively destroyed in the presence of photographically developed silver. Examples of such silver-dye-bleach processes which utilize acidic bleach solutions are described in detail in Mees and James *The Theory of the Photographic Processes* (3rd Edition) at pages 394–395. Catalysts that oxidize metallic silver to silver ion and other bleaching agents as described in U.S. Pat. No. 3,503,741 can also be used in the silver-dye-bleach step of our process. Preferred silver-dye-bleach solutions consist essentially of an acid and a dye bleach catalyst dissolved in water, the resulting solution having a pH of from less than 1 to about 3 (preferably about 1).

In an alternative embodiment of this invention, the dye can be catalytically generated by the developed silver after first removing silver halide from non-image areas by the application of a fixing solution and a washing step.

As used herein, the term "colorless dye former" includes any compound which reacts (or couples) with the oxidation products of a color developer material such as a primary aromatic amino developing agent to form a bleachable dye and is non-diffusible in a hydrophilic colloid binder (e.g., gelatin) useful as the binder in photographic silver halide emulsions. Thus, the term "colorless dye former" includes certain of the materials which are commonly referred to as photographic color-forming "coupler" compounds. Typical useful colorless dye formers include color couplers, such as phenolic, naphtholic, 5-pyrazolone and open-chain ketomethylene couplers which can form bleachable dyes, as defined above. Specific cyan, magenta and yellow dye-forming couplers which can be employed in the practice of this invention are described in Graham et al, U.S. Pat. No. 3,046,129 issued Jan. 24, 1962, column 15, line 45, through column 18, line 51, which disclosure is incorporated herein by reference. Such color-forming couplers can be dispersed in any convenient manner, such as by using the solvents and the techniques described by U.S. Pat. No. 2,322,027 by Jelly et al issued June 15, 1943, or U.S. Pat. No. 2,801,171 by Fierke et al issued July 30, 1957. Other useful couplers include bleachable-dye-producing Fischer-type incorporated color-forming couplers such as some of those described in Fischer, U.S. Pat. No. 1,055,155 issued Mar. 4, 1913, and particularly non-diffusible Fischer-type couplers containing branch carbon chains, e.g., those referred to in the references cited in Frohlich et al, U.S. Pat. No. 2,376,679 issued May 22, 1945, column 2, lines 50–60.

In certain preferred embodiments, the incorporated colorless dye formers in the layer units of this invention are water-insoluble color-forming couplers which are incorporated in a moderately polar coupler solvent. Typical useful solvents include tri-o-cresyl phosphate, di-n-butyl phthalate, diethyl lauramide, 2,4-diarylphenyl liquid dye stabilizers as described in an article entitled "Improved Photographic Dye Image Stabilizer-Solvent", *Product Licensing Index*, Vol. 83, March 1971, and the like. Additional colorless dye formers which can be employed in the practice of this invention are described in the article "Color Photography" by Thirtle et al, *Encyclopedia of Chemical Technology*, Vol. 5, page 832 and include phenols or aromatic amines which upon oxidative condensation with a heterocyclic hydrazone reducing agent produce amidrozone dyes, as well as phenols which upon coupling with the reducing agent beta-arylsulfonhydrazide yield azo dyes. Other useful dye formers include the azo dye forming isoxazolone and indazolone couplers of U.S. Pat. Nos. 2,846,307, and 2,866,706.

The photographic elements which are useful in the practice of this invention, as defined above, comprise a support having thereon image dye-providing layer units. Each layer unit comprises a light-sensitive silver salt, which is generally spectrally sensitized to a specific region of the light spectrum, and has associated therewith an initially colorless dye-former. A multicolor photographic element comprises at least two of said image dye-providing layer units wherein each layer records light primarily in different regions of the light spectrum. In certain embodiments, the color-providing layer units are effectively isolated from other layer units by barrier layers, spacer layers, layers containing scavengers for oxidized developer and the like to prevent any substantial color contamination between the image dye-providing layer units. Methods for accomplishing the effective isolation of the layer units are known in the art and are utilized to prevent color contamination in many commercial color products.

Advantageously, the photographic color formers utilized are selected so that they will give a substantially color balance neutral. Preferably, the cyan dye formed has its major absorption between about 600 and 700 nm., the magenta dye has its major absorption between about 500 and 600 nm., and the yellow dye has its major absorption between about 400 and 500 nm.

Generally, each of the color-providing layer units of the photographic elements contains a light-sensitive silver halide such as silver bromide, silver bromoiodide and the like. In one preferred embodiment, the color-providing layer units comprise a photosensitive silver halide salt at a concentration of up to about 100 mg. of silver per 0.093 square meter.

Numerous color-developing (reducing) agents can be used in the amplifier/developer solutions used in the present process. Reducing agents such as color-developing agents utilized herein undergo redox reaction with the oxidizing agent at a catalytic silver surface. Especially preferred color-developing agents are those which reduce silver halide to metallic silver, such as those which are capable of developing imagewise-exposed light-sensitive photographic silver halide. Typical preferred color-developing agents are aromatic primary amine color-developing agents such as P-aminophenals, which form particularly stable redox combinations with certain complexes, e.g., $Co(NH_3)_6Cl_3$ or p-phenylenediamines. Useful color-developing agents include 3-acetamido-4amino-N,N-diethylaniline, p-amino-N-ethyl-N-β-hydroxyethylaniline sulfate, N,N-diethyl-p-phenylendiamine, 2-amino-5-diethylamino-toluene, N-ethyl-N-β-methanesulfonamidoethyl-3-methyl-4-aminoaniline, 4-amino-N-ethyl-3-methyl-N-(β-sulfoethyl)aniline, 4-amino-N-butyl-N-γ-sulfobutylaniline, 4-amino-N,N-diethyl-3-n-propylaniline hydrochloride, and the like. See Bent et al, *JACS*, Vol. 73, pp. 3100–3125 (1951), and Mees and James, *The Theory of the Photographic Process*, 3rd Edition, 1966, published by MacMillan Co., New York, pp. 278–311, for further typical, useful developing agents. It will be appreciated that many of the subject color-developing agents are most effective at high pH, such as a pH from about 8 to 13.

In one highly preferred embodiment, aromatic primary amino color-developing agents which provide good results in the process of this invention are 4-amino-N,N-diethylaniline hydrochloride, 4-amino-3methyl-N,N-diethylaniline hydrochloride, 4-amino-3-methyl-N-ethyl-N-β-(methanesulfonamido) ethylaniline sulfate hydrate, 4-amino-3-methyl-N-ethyl-N-β-hydroxyethylaniline sulfate, 4-amino-3-dimethylamino-N,N-diethylaniline sulfate hydrate, 4-amino-3-methoxy-N-ethyl-N-β-hydroxyethylaniline hydrochloride, 4-amino-N-ethyl-N-(2-methoxyethyl)-m-toluidine di-paratoluenesulfonate, and 4-amino3-β-(methanesulfonamido-ethyl-N,N-diethylaniline dihydrochloride. The amplifier/developer solutions generally comprise from about 1.0 to about 25.0 g of color developing agent per liter of amplifier/developer solution and preferably from about 5.0 g. to 15.0 g per liter of solution.

The amplifier/developer solutions can generally comprise any liquid as a carrier medium, but the liquid is preferably predominantly water. The solutions generally comprise from about 0.2 to about 20 g. per liter of the transition metal ion complex (i.e., cobalt (III) complex) which preferably is maintained at between about 1 to about 15 g/l. However, generally higher concentrations of cobalt (III) complexes can be used in preferred amplifier baths of this invention without adverse sensitometric effects.

The amplifier/developer solution generally contains a development restrainer and preferably contains enough development restrainer to repress any further silver formation. Thus, the sensitometric changes associated with the development of silver are avoided. Moreover, this feature enables one to use various grain sizes in various layers of a multicolor element to obtain a balance photographic element and simultaneously provide substantially uniform color formation in each layer, whereby balanced color can be obtained at several densities by inspection.

The organic development restrainers (i.e., other than the inorganic development restrainers such as the alkali metal bromides) can be used in the solution in combination with the inorganic development restrainers or alone, but are preferably used in combination with alkali metal bromides. Generally, the organic development restrainers are used in concentrations of from 0 to 2 g. and preferably from 0.01 to 1 g/l.

The amplifier/developer solution is generally employed in a pH range of from 6 to 14 and preferably at pH ranges of 8 to 12.

The amplifier/developer solution contains only small amounts of, or is substantially free of, silver halide solvents such as sodium thiosulfate, thiocyanates, thioethers and the like. While bromide ions are often desirable in samll amounts of about 2 to 40 g/l of amplifying solution to repress development, high concentrations such as above 200 g/l could function to bleach silver halide layers and, likewise, defeat the primary amplification step. In certain embodiments, it is also desirable to maintain the ammonia in the amplifier at less than 10 g/l since high ammonia concentrations can act as a silver halide solvent, thus allowing bleaching of the silver image before the dye-bleach step.

The amplifier/developer solution can be used over a wide range of temperatures, depending on the effect desired. Generally, the amplifier solution is stable at high temperatures and can therefore be used in processes where it is operated at temperatures above about 32° C (90° F) and more preferably above about 38° C (100° F) to decrease the residence time of a photographic element in the solution, thus speeding up the process. The amplifier solutions of this invention which are held for 1 week at about 40.6° C (105° F) provide substantially the same development properties as a fresh amplifier solution.

The amplifier/developer solutions of this invention preferably contain a coupling accelerator, which can be an alcohol (including aromatic alcohols) such as benzyl alcohol, which appears to increase dye yields. Preferably the alcohol is used in the respective baths at a concentration of up to 40 g/l and preferably from about 2 g to 20 g/l. Coupling accelerators are known in the art, for example, the alcohols disclosed in U.S. Pat. No. 2,304,925 by Jelley issued Dec. 15, 1942, U.S. Pat. No. 2,950,920 by Schwan et al issued Aug. 3, 1960, and the like.

The black-and-white silver halide developers, as referred to herein, generally refer to those developers which do not couple with photographic color-forming couplers to form useful image dyes. The black-and-white silver halide developers can be effectively used in some instances according to this invention in the formation of the metallic silver by a prolonged development step. Typical useful developers of this type include hydroquinones, catechols, 3-pyrazolidones such as 1-phenyl-3-pyrazolidone, 1-phenyl-4,4-dimethyl-3-pyrazolidone, 1-phenyl-4-methyl-3-pyrazolidone and the like 1-, d or isoascorbic acid, reductones, N-methyl-p-aminophenols, and the like. Preferred black-and-white developers are the P-methylaminophenalsulfate-hydroquinone developers such as Kodak DK-50 Developer.

The improved processes of this invention can be carried out in several types of processing equipment. Simple manual tray or dip tank processing can be used, as well as processes as described by Tregillus et al, U.S. Pat. No. 3,179,517 issued Apr. 20, 1965, roller transport processes as described in Russell et al, U.S. Pat No. 3,025,779 issued Mar. 20, 1962, and the like. Preferably, the process is carried out in a unidirectional processing equipment where the element leaves a bath in the same relative direction with respect to the plane of the element as it enters the bath. In certain preferred embodiments, a continuous web of photographic material is processed in unidirectional continuous-processing equipment.

The invention can be further illustrated by the following examples.

Example 1

A silver halide emulsion layer containing 50 mg silver, 250 mg gelatin, and 100 mg of the cyan-dye-forming coupler 5-[α-(2,4-di-tert-amylphenoxy)hexamamido]-2 heptafluorobutylramidophenyl dissolved in 50 mg tricresyl phosphate per 0.93 $m^2$ of coating is coated on a cellulose acetate film support. The element is exposed through a graduated-density test object and then conventionally black-and-white processed at a temperature of (24° C) including the steps of a 3-minute (fogging) development in Kodak D-19 Developer, 1 minute washing, 2 minute fixing in Kodak Rapid Fix, and a 3 minute washing step.

At this point, the sample contains image silver in proportion to the initial exposure, as well as additional silver in areas of no exposure due to the prolongation of the black-and-white development cycle beyond the time required to produce an image of low minimum density.

The element is then treated for 20 minutes at a temperature of (22° C) in the following amplifier/-developer solution and then washed for two minutes.

| Amplifier/Developer Solution | |
|---|---|
| Water | 800 ml |
| Benzyl alcohol | 15 ml |
| $K_2CO_3$ | 7.5 g |
| KBr | 2 g |
| $K_2SO_3$ | 2 g |
| 4-Amino-N-ethyl-N-(2-methoxyethyl)-m-toluidine di-PTS | 7.5 g |
| Diaminopropanoltetraacetic acid | 10 g |
| 5-Methylbenzotriazole | 50 mg |
| $[CO(NH_3)_6]Cl_3$ | 10 g |
| Water to 1 liter (pH = 10.1) | |

During the treatment of the sample in the above amplifier solution, dye is formed throughout the emulsion layer as the result of the silver catalyst redox couple reaction between the cobalt complex and the color developing agent and subsequent coupling between oxidized color developing agent and the incorporated coupler.

The element is then silver-dye-bleached in the following solution for one minute:

| | |
|---|---|
| Thiourea | 50 g |
| HCl (conc.) | 50 ml |
| Phenazine | 500 mg |
| Water to 1 Liter | |
| washed for 3 minutes, bleach-fixed in the following solution for 3 minutes: | |
| $[Co(NH_3)_6]Cl_3$ | 5 g |
| Sodium thiosulfate (Hypo) | 25 g |
| Water to 1 Liter | |
| and dried. The element contained a positive cyan dye image of the original. | |

EXAMPLE 2

An element coated as in Example 1 is first image exposed through the same graduated-density test object and then flash exposed for 1 second through a 1.5 neutral density filter to produce a uniform latent image.

The sample is then processed in the following sequence:

| | |
|---|---|
| Black-and-white development in Kodak D-19 Developer | 1 min. |
| Wash | 1 min. |
| Kodak Rapid Fix | 2 min. |
| Wash | 1 min. |

The element now contains a negative silver image and overall low silver fog:

| | |
|---|---|
| Amplifier-Developer of Example 1 | 10 min. |
| Wash | 2 min. |
| The element now contains cyan dye in addition to the developed silver: | |
| Silver-dye-bleach | 1 min. |
| Wash | 3 min. |
| Bleach-fix | 3 min. |
| Wash | 3 min. |
| Drying. | |

The resulting image is a positive cyan dye image of the original.

The invention has been described in detail with particular reference to certain preferred embodiments thereof, but it will be understood that variations and modifications can be effected within the spirit and scope of the invention.

We claim:

1. A process for producing a positive colored image in an imagewise exposed photographic element which comprises a support having coated thereon at least one layer of a hydrophilic colloid coating containing light sensitive silver halide and, in association with said silver halide, a substantially colorless dye-providing compound; said dye-providing compound being reactive with oxidized color-forming reducing agent to yield a bleachable dye; which process comprises the following steps in the order presented:

a. contacting said element with a black-and-white developer solution to thereby develop image silver and form a low level silver fog in the non-image areas of said element of from about 0.08 optical density unit to about 20 percent of the maximum silver image density;

b. uniformly converting said substantially colorless dye-providing compound to said bleachable dye by contacting the black-and-white developed element with an amplifier/developer solution containing a color-forming reducing agent and a cobalt (III) metal complex amplifier oxidizing agent having a coordination number of 6 capable of entering into an oxidation-reduction reaction with the color-forming reducing agent in the presence of a catalytic silver surface;

c. silver-dye-bleaching said element to bleach said bleachable dye in proportion to the amount of metallic silver in the respective areas of said element; and d. thereafter, removing silver halide from said element by means of a fixing solution.

2. A process as in claim 1, wherein the amount of said silver fog formed in step (a) is at most about 20 percent of the bleachable dye equivalent in said layer.

3. A process as in claim 1, wherein, in step (a) said image silver and said silver fog are formed simultaneously.

4. The process for producing a colored image as defined in claim 1 wherein said dye-providing compound is a color-forming coupler and said color -forming reducing agent is an aromatic primary amine.

5. A process for producing a positive colored image in an imagewise exposed photograhic element which comprises a support having coated thereon at least three separate overlying hydrophilic colloid layers containing light sensitive silver halide, said layer being sensitive to red, green and blue radiation, respectively, said layers having in association therewith substantially colorless dye-providing compounds which provide, respectively, cyan, magenta and yellow bleachable dye, each said dye-providing compound being reactive with oxidized color-forming reducing agent to yield a bleachable dye which process comprises the following steps in the order presented:

a. contacting said element with a black-and-white developer solution to thereby develop image silver while simultanously forming a low level silver fog in the non-image areas of said element of from about 0.08 optical density unit to about 20 percent of the maximum amount of silver formed in the image area of said element;

b. uniformly converting the dye-providing compounds to said bleachable dyes by contacting the black-and-white developed element with an amplifier/developer solution containing a color-forming reducing agent and a cobalt (III) metal complex amplifier oxidizing agent having a coordination number of 6 capable of entering into an oxidation-reduction reaction with the colorforming reducing agent in the presence of a catalytic silver surface;

c. silver-dye-bleaching said element to bleach said bleachable dye in proportion to the amount of metallic silver in the respective areas of said element; and d. thereafter, removing silver halide from said element by means of a fixing solution.

6. A process as in claim 5, wherein the amount of said silver fog formed in step (a) is at most about 20 percent of the bleachable dye equivalent in said layer.

7. A process for producing a positive colored image in an imagewise exposed photographic element which comprises a support having coated thereon at least three separate overlying hydrophilic colloid layers containing light sensitive silver halide, said layers being sensitive to red, green and blue radiation, said layers having in association therewith respectively, phenolic, 5-pyrazolone and ketomethylene couplers which provide cyan, magenta and yellow bleachable dye, which process comprises the following steps in the order presented:

a. contacting said element with a black-and-white developer solution to thereby develop image silver while simultanously forming a low level silver fog in the non-image areas of said element of from about 0.08 optical density unit to about 20 percent of the maximum amount of silver formed in the image area of said element;

b. uniformly converting the coupler to said bleachable dye by contacting the black-and-white developed element with an amplifier/developer solution containing a color-forming reducing agent and a cobalt (III) metal complex amplifier oxidizing agent having a coordination number of 6 capable of entering into an oxidation-reduction reaction with the color-forming reducing agent in the presence of a catalytic silver surface;

c. silver-dye-bleaching said element to bleach said bleachable dye in proportion to the amount of metallic silver in the respective areas of said element; and d. thereafter, removing silver halide from said element by means of a fixing solution.

8. A process as in claim 7, wherein the amount of said silver fog formed in step (a) is at most about 20 percent of the bleachable dye equivalent in said layer.

9. A process for producing a positive colored image in an imagewise exposed photographic element which comprises a support having coated thereon at least one layer of a hydrophilic colloid coating containing light sensitive silver halide and, in association with said silver halide, a dye-providing compound; said dye-providing compound being reactive with oxidized color-forming reducing agent to yield a bleachable dye; which process comprises the following steps in the order presented:

a. contacting said element with a black-and-white developer solution to thereby develop image silver while simultaneously forming a low level silver fog in the non-image areas of said element of from above 0.8 optical density unit to about 20 percent of the maximum amount of silver formed in the image area of said element;

b. fixing and washing said element;

c. uniformly converting the dye-providing compound to said bleachable dye by contacting the black-and-white developed element with an amplifier/developer solution containing a color-forming reducing agent and a cobalt (III) metal complex amplifier oxidizing agent having a coordination number of 6 capable of entering into an oxidation-reduction reaction with the color-forming reducing agent in the presence of a catalytic silver surface;

d. silver-dye-bleaching said element to bleach said bleachable dye in proportion to the amount of metallic silver in the respective areas of said element; and e. thereafter, removing silver halide from said element by means of a fixing solution.

10. A process as in claim 9, wherein the amount of said silver fog formed in step (a) is at most about 20 percent of the bleachable dye equivalent in said layer.

11. The process for producing colored images as defined in claim 9 wherein the dye-providing compound is a color coupler and the color-developing agent is an aromatic primary amine.

12. A process for producing positive colored images in an imagewise exposed photographic element which comprises a support having coated thereon at least three separate overlying hydrophilic colloid layers containing light sensitive silver halide, said layers being sensitive to red, green and blue radiation respectively, said layers having in association therewith dye-providing compounds which provide, respectively cyan, magenta and yellow bleachable dye; which process comprises the following steps in the order presented:

a. contacting said element with a black-and-white developer solution to thereby develop image silver while simultaneously forming a low level silver fog in the non-image areas of said element of from about 0.08 optical density unit to about 20 percent of the maximum amount of silver formed in the image area of said element;

b. fixing and washing said element;

c. uniformly converting the dye-providing compound to said bleachable dye by contacting the black-and-white developed element with an amplifier/developer solution containing a color-forming reducing agent and a cobalt (III) metal complex amplifier oxidizing agent having a coordination number of 6 capable of entering into an oxidation-reduction reaction with the colorforming reducing agent in the presence of a catalytic silver surface;

d. silver-dye-bleaching said element to bleach said bleachable dye in proportion to the amount of metallic silver in the respective areas of said element; and e. thereafter, removing silver halide from said element by means of a fixing solution.

13. A process as in claim 12, wherein the amount of said silver fog formed in step (a) is at most about 20 percent of the bleachable dye equivalent in said layer.

14. A process for producing positive colored images in an imagewise exposed photographic element which comprises a support having coated thereon at least three separate overlying hydrophilic colloid layers containing light sensitive silver halide, said layers being sensitive to red, green and blue radiation, respectively, said layers having in association therewith respectively, phenolic, 5-pyrazolone and ketomethylene couplers which provide cyan, magenta and yellow bleachable dye, which process comprises the following steps in the order presented:

a. contacting said element with a black-and-white developer solution to thereby develop image silver while simultaneously forming a low level silver fog in the non-image areas of said element of from above 0.08 optical density unit to about 20 percent of the maximum amount of silver formed in the image area of said element;

b. fixing and washing said element;

c. uniformly converting the dye-providing compound to said bleachable dye by contacting the black-and-white developed element with an amplifier/-developer solution containing a color-forming reducing agent and a cobalt (III) metal complex amplifier oxidizing agent having a coordination number of 6 capable of entering into an oxidation-reduction reaction with the color-forming reducing agent in the presence of a catalytic silver surface;

d. silver-dye-bleaching said element to bleach said bleachable dye in proportion to the amount of metallic silver in the respective areas of said element; and e. thereafter, removing silver halide from said element by means of a fixing solution.

15. A process as in claim 14, wherein the amount of said silver fog formed in step (a) is at most about 20 percent of the bleachable dye equivalent in said layer.

16. A process for producing a positive colored image in an imagewise exposed photographic element which comprises a support having coated thereon at least one layer of gelatin containing light sensitive silver halide and, in association with said silver halide, a color-forming coupler selected from the group consisting of phenolic, naphtholic, 5-pyrazolone and open-chain ketomethylene couplers; said color-forming coupler being reactive with oxidized aromatic primary amine developing agent to yield a bleachable dye; which process comprises the following steps in the order presented:

a. black-and-white developing said element by contacting with an Elon-hydroquinone developer solution to thereby develop image silver and form a low level silver fog in the non-image areas of said element; the density of silver in said non-image areas being at least about 0.08 optical density unit to about 20 percent of the maximum amount of silver formed in the image area of said element, and at most 20 percent of the bleachable dye equivalent in said layer;

b. converting substantially all of said color-forming coupler to said bleachable dye by contacting said black-and-white developed element with an amplifier/developer solution containing a cobalt hexammine metal complex amplifier oxidizing agent and an aromatic primary amine reducing agent;

c. silver-dye-bleaching by contacting said element in a silver-dye-bleach solution containing an acid and a dye bleach catalyst and having a pH of at most about 3 to thereby bleach said bleachable dye in proportion to the amount of metallic silver in the respective areas of said element; and d. thereafter bleach-fixing said element in a cobalt hexammine sodium thiosulfate bleach-fix solution.

17. A process for producing a positive colored image in an imagewise exposed photographic element which comprises a support having coated thereon at least one layer of a hydrophilic colloid coating containing light sensitive silver halide and, in association with said silver halide, a substantially colorless, image dye-providing compound; said image dye-providing compound being reactive with oxidized color-forming reducing agent to yield a bleachable image dye; which process comprises the following steps:

a. developer a silver image in the imagewise exposed areas of the photographic element and forming a low level silver fog of from about 0.08 optical density unit to about 20 percent of the maximum density of the silver image while retaining said image dye-providing compound in its substantially colorless form;

b. uniformly converting said substantially colorless, image dye-providing compound to said bleachable image dye by contacting the element with an amplifier/developer solution containing a color-forming reducing agent and a cobalt (III) complex amplifier oxidizing agent having a coordination number of 6 capable of entering into an oxidation-reduction reaction with color-forming reducing agent in the presence of a catalytic silver surface;

c. bleaching said image dye in proportion to the amount of silver present in the respective areas of said element; and d. thereafter fixing any residual silver halide remaining in said element by means of a fixing solution.

18. A process as in claim 17, wherein bleaching of said image dye is accomplished using silver as a reducing agent and in the silver fog is at most present in an amount of sufficient to bleach 20 percent of said image dye.

19. A process for producing a positive colored image in an imagewise exposed photographic element which comprises a support having coated thereon at least one layer of a hydrophilic colloid coating containing light sensitive silver halide and, in association with said silver halide, a substantially colorless, image dye-providing compound; said image dye-providing compound being reactive with oxidized color-forming reducing agent to yield a bleachable image dye; which process comprises the following steps:

a. developing a silver image in the imagewise exposed areas of the photographic element and forming a low level silver fog of from about 0.08 optical density unit to about 20 percent of the maximum density of the silver image while retaining said image dye-providing compound in its substantially colorless form;

b. fixing and washing said element;

c. uniformly converting said substantially colorless, image dye-providing compound to said bleachable image dye by contacting the element with an amplifier/developer solution containing a color-forming reducing agent and a cobalt (III) complex amplifier oxidizing agent having a coordination number of 6 capable of entering into an oxidation-reduction reaction with the color-forming reducing agent in the presence of a catalytic silver surface;

d. bleaching said image dye in proportion to the amount of silver present in the respective areas of said element; and e. thereafter fixing any residual silver halide remaining in said element by means of a fixing solution.

20. A process as in claim 19, wherein bleaching of said image dye is accomplished using silver as a reducing agent and the silver fog is at most present in an amount sufficient to bleach 20 percent of said image dye.

* * * * *

UNITED STATES PATENT AND TRADEMARK OFFICE

CERTIFICATE OF CORRECTION

PATENT NO. : 4,022,616

DATED : May 10, 1977

INVENTOR(S) : Charles Robert Barr and John Vincent Williams

It is certified that error appears in the above-identified patent and that said Letters Patent are hereby corrected as shown below:

Column 1, line 52, "metod" should read --method--. Column 3, line 10, "photograhic" should read --photographic--; line 19, after "coupler", --,-- should be inserted; line 27, "photograhic" should read --photographic--; line 29, after "Image", --dye-- should be inserted; line 43, "oxidation" should read --oxidative--; line 51, that part of the formula reading "P" should read --p--. Column 4, line 4, "cobalt" should read --cobalt(III)--. Column 5, line 3, "the" (first occurrence) should read --The--; line 47, "color couplers" should read --color-forming couplers--. Column 6, line 43, "color balance neutral" should read --neutral color balance--; lines 65-66, "P-aminophenals" should read --p-aminophenols--; last line, after "$Co(NH_3)_6Cl_3$", --,-- should be inserted. Column 8, line 24, "alcohols)" should read --alcohols--; line 25, "alcohol," should read --alcohol),--; line 25, "which appears" should be deleted; line 25, after "increase", --apparent-- should be inserted; line 46, that part of the formula reading "P-methylaminophenalsulfate" should read --p-methylaminophenol sulfate--. Column 10, line 64, "photograhic" should read --photographic--. Column 11, line 22, "colorforming" should read --color-forming--. Column 12, line 65, "colorforming" should read --color-forming--. Column 14, line 22, "developer" should read --developing--; line 36, after "with",

UNITED STATES PATENT AND TRADEMARK OFFICE

CERTIFICATE OF CORRECTION

PATENT NO. :4,022,616

DATED :May 10, 1977

INVENTOR(S) :Charles Robert Barr and John Vincent Williams

It is certified that error appears in the above-identified patent and that said Letters Patent are hereby corrected as shown below:

--the-- should be inserted; line 47, "of" (first occurrence) should be deleted.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*